US006305616B1

(12) United States Patent
Sardello

(10) Patent No.: US 6,305,616 B1
(45) Date of Patent: Oct. 23, 2001

(54) FUEL LINE GASKET

(75) Inventor: David G. Sardello, Coraopolis, PA (US)

(73) Assignee: Sardello, Inc., Aliquippa, PA (US)

( * ) Notice: Subject to any disclaimer, the term of this patent is extended or adjusted under 35 U.S.C. 154(b) by 0 days.

(21) Appl. No.: 09/503,782

(22) Filed: Feb. 14, 2000

Related U.S. Application Data

(60) Provisional application No. 60/121,151, filed on Feb. 22, 1999.

(51) Int. Cl.[7] ..... F02D 1/06

(52) U.S. Cl. ..... 239/5; 239/88; 239/570; 251/150

(58) Field of Search ..... 239/88–92, 570, 239/571, 591, 5; 251/150; 29/890.142; 285/339, 342, 343, 379

(56) References Cited

U.S. PATENT DOCUMENTS 5,328,094 7/1994 Goetzke et al. ..... 239/88

*Primary Examiner*—Lisa Ann Douglas
(74) *Attorney, Agent, or Firm*—Webb Ziesenheim Logsdon Orkin & Hanson, P.C.

(57) ABSTRACT

A gasket for use in an electromotive diesel fuel injector. The gasket is made of a polymeric material and is adapted to be received by a filter nut of the fuel injector.

20 Claims, 3 Drawing Sheets

FUEL LINE GASKET

This appln claims benefit of provisional appln No. 60/121,151, filed Feb. 22, 1999.

BACKGROUND OF THE INVENTION

1) Field of the Invention

The present invention is directed to electromotive diesel (emd) fuel injectors, and more particularly, to gaskets used in emd fuel injectors.

2) Description of the Prior Art

Emd fuel injectors are used in locomotives to inject diesel fuel for combustion. FIG. 1 shows an emd fuel injector 10 that includes a follower 12, a stop pin 14, a stop pin retainer 16, a stop pin spring 18, a body assembly 20, a plunger assembly 22, a gear 24, a seal ring 26, a gear retainer 28, a guide pin 30, a valve nut 32, a spacer 34, a check valve 36, a check valve cage 38, a chart tip assembly 40, a spring seat valve 42, a spring cage valve 44, a valve spring 46, a spill deflector 48, a locating dowel 50, a body plug 52, a rack assembly 54, a rack 56, a rack pin 58, a filter 60, a filter spring 62, a filter cap or a filter nut 64, a plunger spring 66, a fuel connection 68 and fuel line 69, and a calibrating slide 70. Such an emd fuel injector 10 is well known in the art, such as a fuel injector manufactured by General Motors, as well as described in U.S. Pat. No. 5,328,094, which is hereby incorporated by reference.

As shown in more detail in FIGS. 2 and 4, the filter nut 64 (of which two are provided) defines a filter nut fuel line passageway 72 that is in fluid communication with the fuel line 69, which defines a fuel line passageway 74. The fuel line 69 includes a frustaspherical end or fuel line surface 76 that matingly engages or abuts a frustaspherical-shaped surface or nut surface 78 so that fuel line passageways 72 and 74 are aligned.

Referring to FIG. 3, the frustaspherical end 76 sealingly engages the frustaspherical surface 78 through a support block 80 that abuts a connection portion 81 shown in phantom. The support block 80 defines three holes which receive fuel lines 69 and a stud 82. A stud nut 84 is threadably received by the stud 82 and abuts against a surface of the support block 80 and which, in turn, forces the frustaspherical end 76 against the frustaspherical surface 78, thereby forming a liquid seal.

Referring back to FIG. 2, in operation, fuel passes through the fuel line passageways 72 and 74 as indicated by arrows. Over time, the seal formed by the frustaspherical end 76 abutting the frustaspherical surface 78 may fail due to wear caused by vibration and loosening of the stud nut 84. This causes a fuel line leak. The vibration especially is a problem with breaking the seal because both the filter nut 64 and the frustaspherical end 76 are made of steel.

Therefore, it is an object of the present invention to improve the seal between the frustaspherical end 76 and the filter nut 64.

SUMMARY OF THE INVENTION

The present invention is a fuel line gasket for use with an electromotive diesel fuel injector that includes a nut defining a nut fuel line passageway that is in fluid communication with a fuel line having a fuel line passageway. The fuel line includes a fuel line surface and the nut includes a nut surface. The fuel line gasket includes a body interface surface and a hole positioned within the interface surfaces. At least a portion of the body is adapted to be positioned between the fuel line surface and the nut surface, so that the intermediate surfaces contact respective ones of the fuel line surface and the nut surface, and when the portion of the body is compressed between the fuel line surface and the nut surface, a liquid seal is formed and fuel can pass through the fuel line passageway, the nut fuel line passageway and through the hole defined in the body.

Preferably, the fuel line gasket includes a first portion, which includes the intermediate surfaces and the hole, and a depending second portion, which can be hexagonal in shape. Preferably, the gasket is a unitary piece molded from a polymeric material.

The present invention is also a method for providing the above-identified fuel line gasket to a prior art electromotive diesel fuel injector that includes the steps of: a) moving the nut away from the fuel line; b) positioning the gasket between the fuel line surface and the nut surface so that the opposite interface surfaces contact the fuel line surface and the nut surface, respectively; and c) compressing the gasket between the fuel line surface and the nut surface so that the intermediate surfaces contact respective ones of the fuel line surface and the nut surface and a liquid seal is formed there between so that fuel can pass through the fuel line passageway, the nut fuel line passageway and the hole defined in the body.

DESCRIPTION OF THE PREFERRED EMBODIMENT

Figure 1:
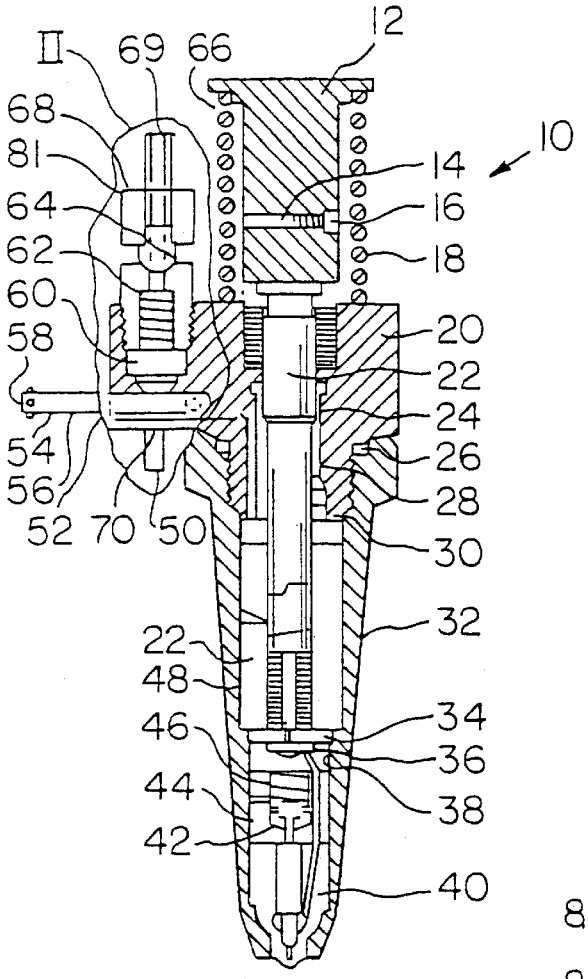
FIG. 1 PRIOR ART
FIG. 1 is a side elevation, partially in section, of a prior art emd fuel injector.
Figure 2:
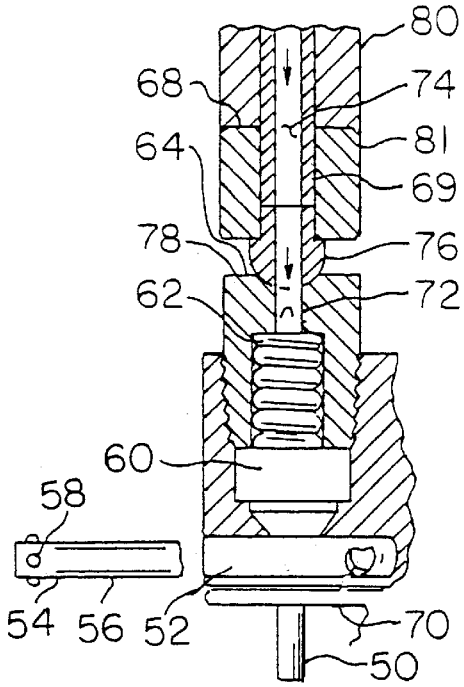
FIG. 2 PRIOR ART
FIG. 2 is an elevation of a portion of the emd fuel injector shown in FIG. 1.
Figure 3:
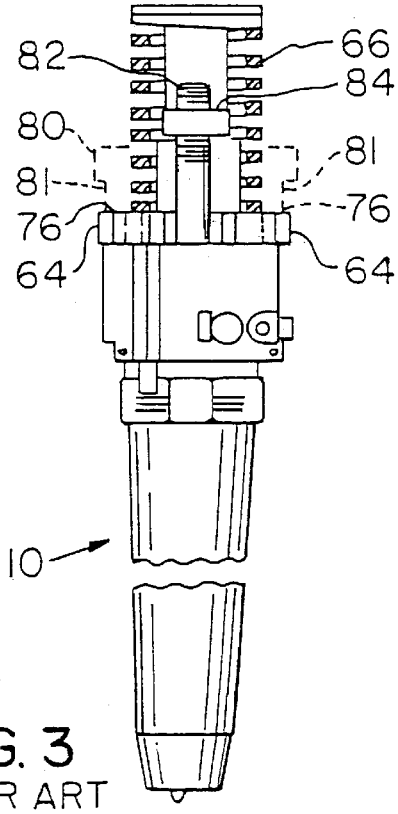
FIG. 3 PRIOR ART
FIG. 3 is a front elevation of a portion of the emd fuel injector shown in FIG. 1.
Figure 4:
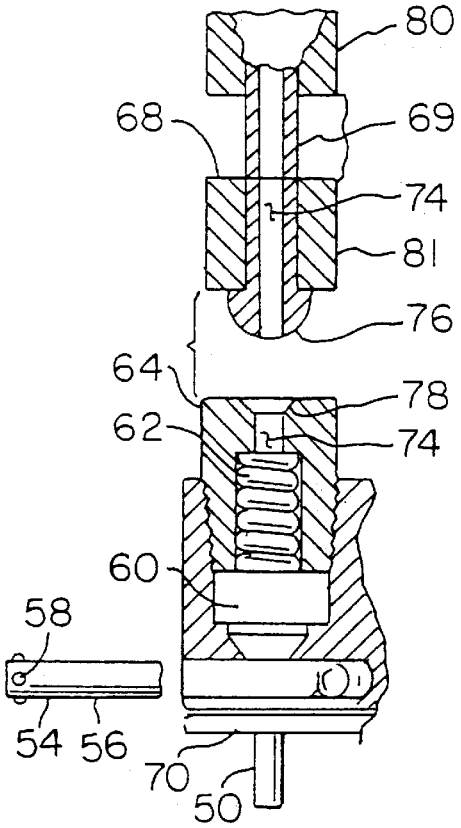
FIG. 4 PRIOR ART
FIG. 4 is a partially exploded view of the prior art arrangement shown in FIG. 2.
Figure 5:
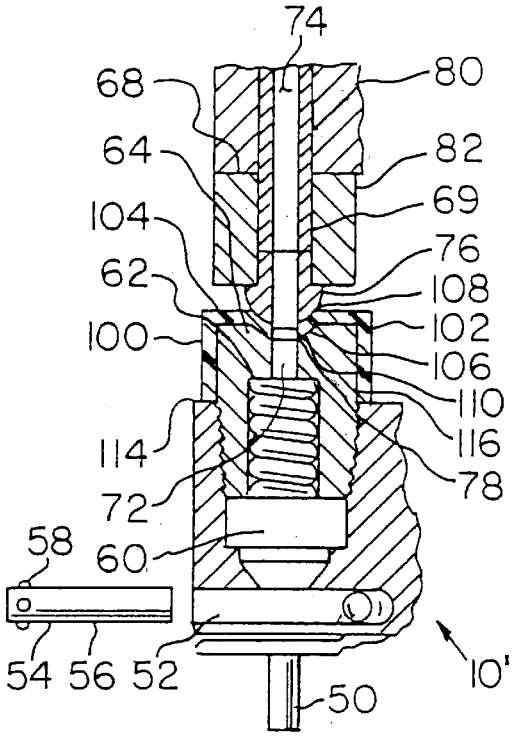
FIG. 5 is an elevation of a portion of an emd fuel injector made in accordance with the present invention.
Figure 6:
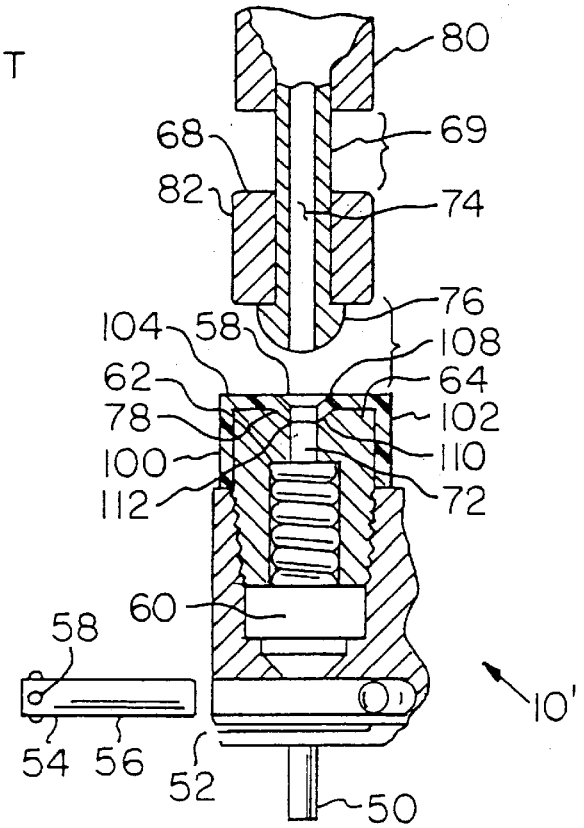
FIG. 6 is an exploded elevation of the portion of the emd fuel injector shown in FIG. 5.
Figure 7A:
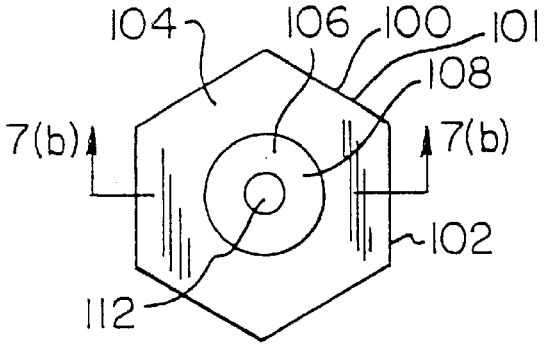
FIGS. 7(*a*)–7(*d*) are a top view, a sectional view, a bottom view and a side view, respectively, of a fuel line gasket made in accordance with the present invention.
Figure 7C:
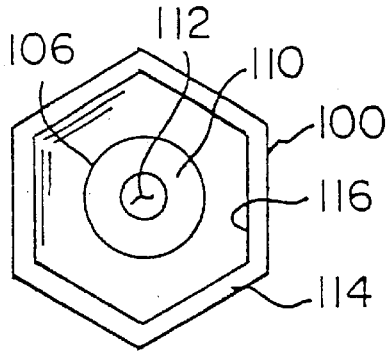
Figure 7B:
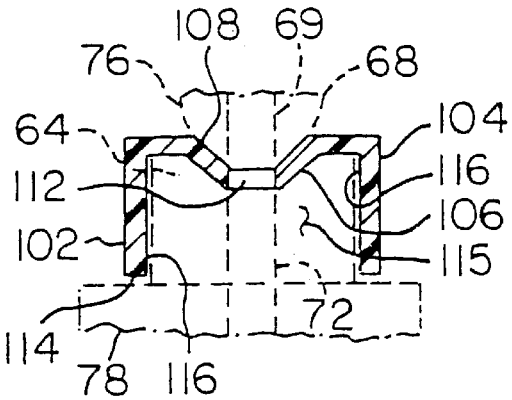
Figure 7D:
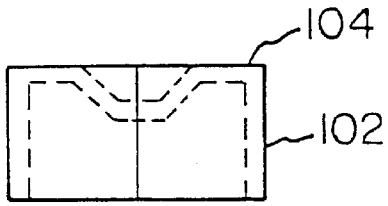

FIGS. 5 and 6 show a portion of an emd fuel injector 10' that includes a fuel line gasket or filter cap gasket 100 made in accordance with the present invention. The emd fuel injector 10' is similar to the prior art emd fuel injector 10 except for the filter cap gasket 100. Therefore, like reference numerals will be used for like parts. As can be seen, the filter cap gasket 100 is sandwiched between the filter nut 64 and the frustaspherical end 76.

Referring to FIGS. 7(*a*)–7(*d*), the filter cap gasket 100 is made of plastic, preferably, ZYTEL® nylon resin manufactured by DuPont Company. Other plastic, polymeric materials, elastomeric materials or rubber can be used.

The filter cap gasket 100 includes a body 101 having two portions, a hexagonal-shaped side 102 attached to a top 104. The top 104 includes a frustaconical portion 106. The hexagonal-shaped side 102 depends from the top 104. Alternatively, the frustaconical portion 106 can be frustaspherical in shape. The frustaconical portion 106 includes two opposite interface surfaces 108 and 110. A hole 112 is defined by the frustaconical portion 106 and is positioned within the interface surfaces 108 and 110. A bottom surface 114 is defined at a bottom of the hexagonal-shaped sides 102. A nut receiving cavity 115 is defined by the hexagonal-shaped side 102 and the top 104. Preferably, the filter cap gasket 100 is a unitary molded piece.

Referring back to FIGS. 5 and 6, an inner portion 116 of the filter cap gasket 100 is fit over or mates with an upper portion of the filter nut 64, which is hexagonal shaped, so that at least a portion of the body 101 is positioned between the fuel line surface 76 and the nut surface 78. The filter nut 64 has a hexagonal portion over which the filter cap gasket 100 fits. The filter cap gasket can also include geometric or polygonal shapes depending on the shape of the filter nut 64 on which it is to fit. The frustaconical portion 106 interface surface 110 abuts against the frustaspherical-shaped nut surface 78, as shown in FIG. 6, so that the hole 112 aligns with the fuel line passageway 72. The frustaspherical-shaped fuel line surface 76 is then placed on the interface surface 108 so that the fuel line passageway 74 aligns with the hole 112. Hence, the intermediate surfaces 108 and 110 contact the respective fuel line surface 76 and nut surface 78. The support block 80 is then placed on the connection portion 82 and the stud nut 84 is tightened so that the frustaspherical end 76 squeezes or compresses the frustaconical portion 106 of the body 101 between the nut surface 78 and the fuel line surface 76 thereby forming a liquid seal therebetween. Diesel fuel can now pass through fuel line passageway 74, hole 112 and fuel line passageway 72.

As stated earlier, the nut surface 78 and the fuel line surface 76 are frustaspherical shaped and are adapted to matingly contact each other, and likewise, the interface surfaces 108 and 110 are adapted to mate with the respective surfaces 76 and 78. The squeezed filter cap gasket 100 provides shock absorption and prevents wear of the frustaspherical end 76 and the nut surface 78 of the filter nut 64.

The present invention is also well suited for providing the fuel line gasket 100 with a prior art emd fuel injector 10 where a liquid seal is formed by the fuel line surface 76 matingly engaging with the nut surface 78. Specifically, the stud nut 84 is removed from the stud 82 and the support block 80 is removed. The filter nut 64 is moved away from the fuel line 69 so that the fuel line surface 76 is spaced away from the nut surface 78. The gasket 100 is placed over a portion of the filter nut 64, which is received in the nut receiving cavity 115 so that the respective hexagonal surfaces contact each other and the interface surface 110 contacts the nut surface 78. The fuel line surface 76 is then placed on the interface surface 108 and the support block is then placed on the stud 82. The stud nut 84 is then tightened so that the gasket 100 is sandwiched and compressed between the fuel line surface and the nut surface and a liquid seal is formed there between, so that the fuel can pass through the fuel line passageway 74, the nut fuel line passageway 72 and the hole 112 in a leak free manner.

Having described the presently preferred embodiments of the invention, it is to be understood that it may be otherwise embodied within the scope of the appended claims.

I claim:

1. A method for providing a fuel line gasket to an electromotive diesel fuel injector wherein the electromotive diesel fuel injector includes a nut defining a nut fuel line passageway that is in fluid communication with a fuel line having a fuel line passageway, the fuel line having a fuel line surface and the nut having a nut surface, said fuel line surface and said nut surface sealing by contacting each other, and wherein the fuel line gasket includes a body having two opposite interface surfaces with a hole defined within the interface surfaces, at least a portion of said body adapted to be positioned between the fuel line surface and the nut fuel surface, said method comprising the steps of:

a) moving the nut away from the fuel line;

b) positioning the gasket between the fuel line surface and the nut surface so that the opposites interface surfaces contact the fuel line surface and the nut surface, respectively; and c) compressing the gasket between the fuel line surface and the nut surface so that the interface surfaces contact respective ones of the fuel line surface and the nut surface and a liquid seal is formed there between so that fuel can pass through the fuel line passageway, the nut fuel line passageway and the hole defined in the body.

2. A fuel line gasket for use with an electromotive diesel fuel injector that includes a nut defining a nut fuel line passageway that is in fluid communication with a fuel line having a fuel line passageway, the fuel line having a fuel line surface and the nut having a nut surface, said fuel line gasket, comprising:

a body having two opposite interface surfaces and a hole positioned within said interface surfaces, at least a portion of said body adapted to be positioned between the fuel line surface and the nut surface, so that said interface surfaces contact respective ones of the fuel line surface and the nut surface, and when said portion of said body is compressed between the fuel line surface and the nut surface, a liquid seal is formed and fuel can pass through the fuel line passageway, the nut fuel line passageway and through the hole defined in said body.

3. A fuel line gasket as claimed in claim 2, wherein said body includes a first portion connected to a depending second portion, the first portion includes said interface surfaces and the hole, and said second portion includes a nut receiving cavity, adapted to receive the nut.

4. A fuel line gasket as claimed in claim 3, wherein said body is a unitary piece.

5. A fuel line gasket as claimed in claim 4, wherein said body is molded.

6. A fuel line gasket as claimed in claim 5, wherein said body is formed by a polymeric material.

7. A fuel line gasket as claimed in claim 3, wherein said body is adapted to matingly engage with a portion of the nut.

8. A fuel line gasket as claimed in claim 7, wherein the second portion is geometrically shaped.

9. A fuel line gasket as claimed in claim 8, wherein the second portion is polygon.

10. A fuel line gasket as claimed in claim 9, wherein said second portion is a hexagon.

11. A fuel line gasket as claimed in claim 2, wherein the nut surface and the fuel line surface are frustaspherical shaped and are adapted to matingly contact each other, and wherein said interface surfaces are adapted to mate with the respective nut surface and the fuel line surface.

12. A fuel line gasket as claimed in claim 11, wherein said intermediate surfaces are of the group of frustaconical shaped and frustaspherical shaped.

13. In an electromotive diesel fuel injector that includes a nut defining a nut fuel line passageway that is in fluid communication with a fuel line having a fuel line passageway, the fuel line having a fuel line surface and the nut having a nut surface, the improvement comprising a fuel line gasket positioned between the fuel line surface and the nut surface, said gasket comprising:

a body having two opposite interface surfaces and a hole positioned within the interface surfaces, at least a portion of said body positioned between the fuel line surface and the nut surface, so that said interface surfaces contact respective ones of the fuel line surface and the nut surface, wherein at least a portion of said body is compressed between the fuel line surface and the nut surface, a liquid seal is formed and fuel can pass through the fuel line passageway, the nut fuel line passageway and through the hole defined in said body.

14. A fuel line gasket as claimed in claim 13, wherein said body includes a first portion connected to a depending second portion, the first portion includes said intermediate surfaces and the hole, and said second portion includes a nut receiving cavity, adapted to receive the nut.

15. A fuel line gasket as claimed in claim 14, wherein said body is a unitary piece.

16. A fuel line gasket as claimed in claims 15, wherein said body is molded.

17. A fuel line gasket as claimed in claim 16, wherein said body is formed by a polymeric material.

18. A fuel line gasket as claimed in claim 14, wherein said body matingly engages with a portion of the nut.

19. A fuel line gasket as claimed in claim 18, wherein the second portion on is polygon.

20. A fuel line gasket as claimed in claim 13, wherein said intermediate surfaces are of the group of frustaconical shaped and frustaspherical shaped.

* * * * *

UNITED STATES PATENT AND TRADEMARK OFFICE

CERTIFICATE OF CORRECTION

PATENT NO. : 6,305,616 B1
DATED : October 23, 2001
INVENTOR(S) : David G. Sardello It is certified that error appears in the above-identified patent and that said Letters Patent is hereby corrected as shown below:

Column 3,
Line 66, "sealing by" should read -- sealingly --.

Column 4,
Line 57, "intermediate surfaces" should read -- interface surfaces --.

Column 6,
Line 1, "in claims 15" should read -- in claim 15 --.
Line 9, "portion on is" should read -- portion is --.

Signed and Sealed this

Fourteenth Day of May, 2002

*Attest:*

*Attesting Officer*

JAMES E. ROGAN
*Director of the United States Patent and Trademark Office*